United States Patent [19]

Doundoulakis

[11] Patent Number: 4,860,702

[45] Date of Patent: Aug. 29, 1989

[54] COMPRESSION RATIO CONTROL IN RECIPROCATING PISTON ENGINES

[76] Inventor: George J. Doundoulakis, 2498 Kayron La., North Bellmore, N.Y. 11710

[21] Appl. No.: 170,803

[22] Filed: Mar. 21, 1988

[51] Int. Cl.[4] ..... F02B 75/04

[52] U.S. Cl. ..... 123/78 F

[58] Field of Search ..... 123/78 R, 78 E, 78 F, 123/48 B

[56] References Cited

U.S. PATENT DOCUMENTS

| | | | |
|---|---|---|---|
| 3,686,972 | 8/1972 | McWhorter | 123/78 F X |
| 3,861,239 | 1/1975 | McWhorter | 123/78 F X |
| 4,738,230 | 4/1988 | Johnson | 123/78 F X |

FOREIGN PATENT DOCUMENTS

| | | | |
|---|---|---|---|
| 0692084 | 10/1930 | France | 123/78 F |
| 0064131 | 5/1980 | Japan | 123/78 F |
| 1048144 | 10/1983 | U.S.S.R. | 123/78 F |

*Primary Examiner*—Willis R. Wolfe

[57] ABSTRACT

The object of the invention is to provide means for continuously adjusting the value of the compression ration in Otto-cycle reciprocating piston engines, for increasing their thermal efficiency, especially at part throttle operation. Embodiment A provides means for continuously adjusting the position of the crankshaft 18 in the crankcase (30); while according to Embodiment B, the position of the connecting rod's head bearing (51) is being adjusted with respect to the cylinder heads by predetermined continuous rotation of eccentric cylinders (17) which are used to support the bearings. Means are shown for accurately meshing the crankshaft gear to the transmission gear in Embodiment A and for introducing predetermined rotational phase shifts to the eccentric cylinders in Embodiment B.

9 Claims, 3 Drawing Sheets

FIG. 1
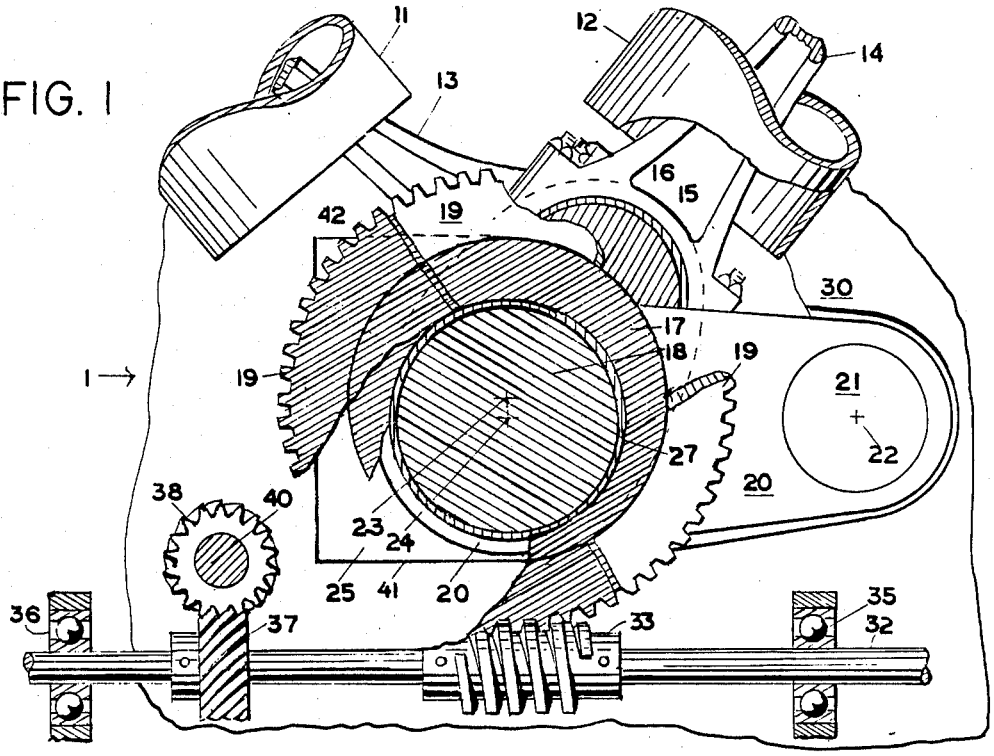
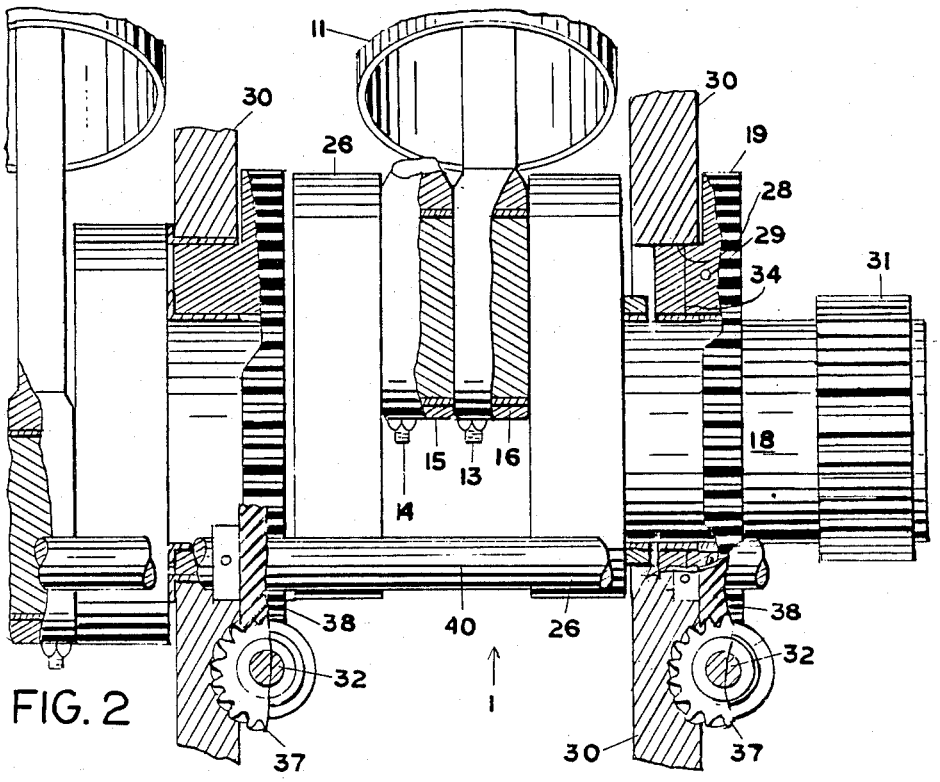
FIG. 2

COMPRESSION RATIO CONTROL IN RECIPROCATING PISTON ENGINES

TECHNICAL FIELD

The present invention relates in general to engines and in particular to a novel means for continuously varying the compression ratio in reciprocating piston engines, by adjusting the distance of parts of the crankshaft mechanism from the cylinder head in terms of a rotation of a single input shaft, and, thereby, vary the ratio of maximum to minimum volume in the cylinder, as the pistons reciprocate.

BACKGROUND ART

Heretofore, with few exceptions, reciprocating engines have been designed to operate at a fixed compression ratio, which is the ratio of the maximum volume to minimum volume in an engine cylinder during each compression/expansion cycle. The minimum volume occurs with the piston at "Top Dead Center" (TDC) and the maximum volume at "Bottom Dead Center" (BDC). An Otto cycle engine is designed to operate with the highest value of compression ratio that will preclude knocking at full throttle. Higher values of compression ratio help increase thermal efficiency according to the well known expression, $$E=1-(1/r)^{k-1} \quad (1)$$

where

E denotes thermal efficiency r denotes compression ratio, and k is equal to the ratio of specific heats cp and cv at constant pressure and constant volume, and, in this instance, has a value close to 1.4.

While the efficiency improvement predicted by equation (1) may not quite be reached in practice, the expression serves to show the substantial influence of compression ratio upon thermal efficiency.

Higher values of compression ratio do not necessarily imply higher values of pressure and temperature. As pressure and temperature are functions of both volume and mass of the gas in-taken, while compression ratio is a ratio of volumes, temperature and pressure may be kept below a particular level by an increase in the size of the cylinder for fixed mass of the gas, or by a decrease in the mass of gas for same size of cylinder. It can be shown that for a particular amount of fuel mixture intaken at full throttle the compression ratio could be increased from a value r1 to a higher value r2 without increasing maximum temperature and pressure, if the size of the cylinder is increased by a factor equal to $(r2-1)/(r1-1)$. Conversely, for same size cylinder the pressure and temperature will not exceed the previous levels if the throttle is adjusted to permit, in the instance of the higher compression ratio r2, only a $(r1-1)/(r2-1)$ portion of gas of what would have entered the cylinder at full throttle at compression ratio r1. These relationships are based on purely geometrical considerations and do not reflect the effect of other parameters, such as spark advance, rates of combustion and heat transfers. However, detailed computer simulation has shown that even after all the factors are taken into account the dominant relationship in part throttle operation still remains approximately equal to the $(r1-1)/(r2-1)$ relationship.

Higher temperatures and pressure values than those now prevailing in gasoline engines are undesirable as they produce knocking and more NOx pollutants.

It is understood by every driver that the power demand on automotive engines continuously varies with driving conditions. Use of the accelerator pedal helps in throttling more or less fuel to provide for the power demand. It is also known to the automobile drivers that seldom do they have to keep the accelerator pedal all the way down to the floor and that on the average they drive at part throttle. The automobiles therefore could be more fuel efficient if they were to be operated with a compression ratio value that could continuously vary with power demand to maintain maximum, temperature and pressure just below knocking levels.

This reasoning was used during the early sixties by the British Internal Combustion Engine Research Association (BICERA) to design a piston that could self adjust the compression ration on the basis of the pressure in the combustion chamber. This was implemented by providing a double piston, the actual piston telescoping over an internal piston. The extend of the telescoping, corresponding to higher compression ratio values, was accomplished by the amount of oil which was introduced during the intake stroke in the space between the two pistons and did not escape back to the reservoir. Higher pressures squeezed more oil from in between the two pistons to the reservoir, causing the outer piston to withdraw away from the cylinder head, thereby reducing the compression ratio. To quote from *Air-Cooled Automotive Engines*, by Julius Mackerie, John Willey & Sons, 1972 p. 372, "In the Continental engine, performance was increased by 50% without increasing the maximum pressure acting on the piston. At the same time conditions were improved for cold starting and for multi-fuel operation at increased compression ratio under partial load."

The objections to the BICERA approach for controlling the compression ratio, upon which the present invention provides improvements, are:

(1) As each cylinder functions independently from the other cylinders, wear, inaccuracies and fowling of the internal valves by hard particles in the oil, can generate unbalance, causing each cylinder to operate at a different compression ratio.

(2) The BICERA design provides only an approximate control of the compression ratio; while in today's computerized automobile engines with electronic injection and detailed information of the combustion process, it is desirable to have a more accurate control of the compression ratio.

A detailed computer simulation of the thermodynamic processes during each engine cycle revealed that while the capability of varying the compression ratio in reciprocating gasoline engines can provide an increase in the indicated thermal efficiency from about 30% to 35% for a change in compression ratio from 8.5:1 to 20:1, much greater increases are possible with the simultaneous use of ceramics. Thus an engine having its piston and cylinder head covered with ceramic and operated at 89% of open throttle and a fixed compression ratio of 8.5:1 would yield an indicated efficiency of about 34%; while the variable compression ratio its efficiency can go as high as 43.6% at a compression ratio of 20:1 and 40% throttle. During this type of operation the throttle opening is being continuously adjusting according to the $(r1-1)/(r2-1)$ law, with r1 having been assigned a value equal to 8.5:1. This is extremely encouraging, especially when considering that a totally ceramic engine with much greater risks, turns out to yield only about 1.5% indicated efficiency. The facility of adjusting the compression ratio, therefore, can provide in this instance, a working performance improvement of 27% in indicated efficiency, with minor changes in both pressure and temperature, at part throttle.

DISCLOSURE OF INVENTION

The present invention provides continuous and accurate controls of the compression ratio in all cylinders in terms of rotation of a single shaft input. According to the present invention bearings in the crank mechanism such as the crankshaft journal bearings, or the connecting rods' head bearings, are being displaced, thereby adjusting the effective minimum distance between pistons crowns and cylinder heads to adjust the compression ratio.

The present invention is presented in terms of two embodiments, Embodiment A and Embodiment B.

In accordance with Embodiment A, the journal bearings supporting the crankshaft mechanism are being displaced along the plane bisecting the V angle of the cylinder's axis. For convenience, heretofore, the V angle bisecting plane, and in general the plane defined by the crankshaft axis and the average angle of the axial lines of all cylinders will be referred to as the vertical plane, regardless of whether this plane may or may not be parallel to an actual plum line.

In accordance with Embodiment B the connecting rods' head bearings are being displaced with respect to the cylinder heads.

If S denotes the effective length of the connecting rods, R the crank radius (=Stroke/2), and L the distance between the center line of the crankshaft journal and cylinder head, it can be shown that the compression ratio r is given by, $$r=(L+R-S)/(L-R-S) \text{ or } L=R(r+1)/(r-1)+S \qquad (2)$$

By inserting in (2) R/S=0.2 inches and R=1.75 inches, which are average values in passenger automotive engine practice, and solving separately for compression ratio values of r1=8.5:1 and r2=20:1, the lengths L1 and L2 corresponding to compression ratio values of r1 and r2, are found to be L1=10.966 and L2=10.684 inches, respectively. The difference L1−L2=0.282 inches, then, is the total effective change required in the distance between cylinder head and crank mechanism for a change in compression ratio from 8:1 to 20:1. If rotation of an acentric cylinder is used to adjust for this variation, the eccentricity needed for Embodiment B is about 0.141 inches. For Embodiment A this value has to be divided by the cosine of half the V angle between cylinders. A large V angle, such as 90 degrees will provide the worst case requiring eccentricity of 0.141/cos 45=0.2 inches.

According to Embodiment A, the preferred approach provides for each crankshaft journal to be eccentrically supported by an eccentric cylinder, which is part of a worm gear, driven by a worm. As the worm gear, and therefore the eccentric cylinder, are rotationally adjusted, the effective height of the crankshaft, and therefore its distance from the cylinder head is being adjusted. In order for the gear teeth at the end of the crankshaft to accurately couple with a transmission gear at all times, the crankshaft is being constrained by a second bearing supported by an arm, which is disposed horizontally and is being pivoted about a point (D1+D 2)/2 inches away from the center of the crank shaft; where D1 and D2 are the pitch diameters of said gears. Simultaneously, the eccentric cylinder supporting the crankshaft bearing is prevented from moving vertically, by the horizontal edges of a slot, cutout on the crankcase, and having a vertical width substantially equal to the diameter of the eccentric cylinder.

According to Embodiment B, the adjustment in distance between the crankshaft mechanism and cylinder heads is implemented by eccentric cylinders positioned over the crankpin bearings, while the main crankshaft journal bearings remain fixed. A second bearing is then required between the eccentric cylinder and the connecting rod for each cylinder. The eccentric cylinder is part of a gear which is being driven by the internal teeth of a ring gear. In order that a particular rotational adjustment of the eccentric cylinder remains the same with respect to all cylinders, the ring gear is being constantly rotated proportionately to the crankshaft speed, through teeth on its outside surface. It turns out that after the eccentric cylinders are set for a particular compression ratio value by a displacement between the inner teeth of the ring gear and the teeth of the eccentric cylinder, the proper rotational speed of the ring gear for maintaining that value of compression ratio, is equal to the rotational speed of the crank shaft.

The compression ratio adjustment of the eccentric cylinder is accomplished by rotation phase shifting means involving a differential input mechanism or a rocker/chain-like adjusting mechanism as shown in FIGS. 5 and 6, respectively.

Accordingly, it is an object of this invention to provide a more efficient Otto cycle reciprocating engine by continuously adjusting the effective distance between crankshaft mechanism and cylinder heads; thereby, controlling the compression ratio and therefore the efficiency of the engine.

It is a further object of this invention to provide a more efficient reciprocating engine by continuously controlling its compression ratio by a continuous adjustment of the rotational angle of eccentric cylinders supporting bearings in the crank mechanism; thereby adjusting the effective distance between crankshaft mechanism and cylinder head;

It is a further object of the present invention to provide a more efficient engine operation by providing the capability of accurately controlling the compression ratio in terms of rotation of a single input shaft on the basis of power demand according to a relationship substantially equal to (r1−1)/(r2−1).

The invention is illustrated diagrammatically in the accompanying drawings by way of examples. The diagrams illustrate only the principles of the invention and how these principles are employed in various ways of application. It is, however to be understood that the purely diagrammatic showing does not offer a survey of other possible constructions, and a departure from the constructional features, diagrammatically illustrated, does not necessarily imply a departure from the principles of the invention. Examples of a few other constructions are given. It is, therefore, to be understood that the invention is capable of numerous modifications and variations to those skilled in the art without departing from the spirit and scope of the invention.

In the accompanying drawings, forming part hereof, similar reference characters designate corresponding parts.

BRIEF DESCRIPTION OF DRAWINGS

The details of my invention will be described in connection with the accompanying drawings in which:

FIG. 1 is a perspective, front elevation view of embodiment A of carrying the invention, with portions of it in cross-section and portions cut away for clarity.

FIG. 2 is a side elevation view of embodiment A, shown in FIG. 1, in perspective, with portions of it in cross-section and portions cut away for clarity.

BEST MODE FOR CARRYING THE INVENTION

Embodiment A

Figure 3:
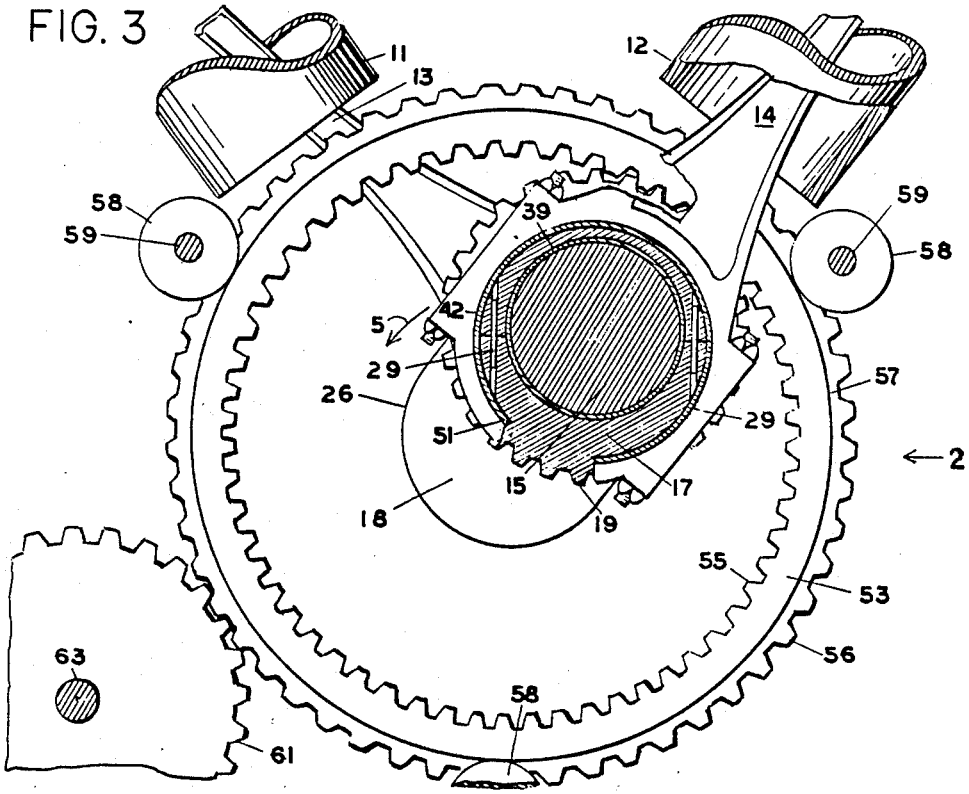
FIG. 3 is a perspective, front elevation view of embodiment B of carrying the invention, with portions of it in cross section and portions cut away for clarity.

Referring to FIGS. 1 and 2, which serve to portray the invention according to the Embodiment A, a portion of a reciprocating engine involving a crankshaft mechanism and its interconnection with the cylinder pistons is shown to comprise a crankshaft 18 with a crankpin 15 extending across crankcheek lobes 26, driving connection rods 13 and 14, which serve cylinders 11 and 12, respectively. The centerline of cylinders 11 and 12, in the example presented, are shown to form a wide V angle, about 90 degrees. The crankshaft 18, shown in cross-section, is being supported by an eccentric cylinder 17 through a crankshaft journal bearing 27. The degree of eccentricity in the cylinder 17 is shown by the distance of its center 23 and the center 24 of the crankshaft 18. As previously explained, the distance between centers 23 and 24 needs be of the order of 0.2 inch in present automotive practice. The eccentric cylinder 17 is being prevented from moving vertically by the horizontal edges 41 and 42 of a slot 25 on the crankcase 30. The eccentric cylinder 17 is rigidly attached and is part of a worm gear 19, driven by a worm 33. In order that the eccentric cylinder 17 with the gear 19 can be fitted over the crankshaft, they may be split in two halves and have a section overlapping with that of the other half so they can be pinned and/or riveted together in one piece. For the purpose of maintaining same compression ratio all for cylinders, the crankshaft 18 is being constrained from moving horizontally by a horizontal arm 20. For proper meshing of the crankshaft gear with the first gear of the transmission, the arm 20 is being pivoted at a point 22, a distance $(D1+D\ 2)/2$, the average of the pitch diameters of the two gears, from the shaft center 24. Assuming the distance between centers 22 and 24 to be of the order of 5 inches, a maximum excursion of the crankshaft, horizontally will be $+5\times(1-\cos(0.2/5)=0.0008$ inches, an insignificant amount. Cylinders on both sides of a V, in case of a V type engine, will, therefore, see the crankshaft moving substantially along the bisector of the V angle (referred to here as the vertical plane), so that the compression ratio will be adjusted equally in each of the compression/expansion cylinders. For assembly, the arm 20 may be constructed in two halves with a section of one overlapping that of the other half for riveting into one piece. A shaft 32 of the worm 33 is supported by bearings 35 and 36 and driven by a pair of same handed helical gears 37 and 38, providing 90 degree transmission. It may be noted that for each main bearing 27 there is a separate driving assembly comprising the eccentric cylinder 17 attached to a worm gear 19, the worm 33 on shaft 32 driven from an input shaft 40, common to all gears 38.

Another approach for adjusting the position of the crankshaft vertically would be by displacing the crankshaft, or a member containing the crankshaft through a journal bearing, by two parallel wedges, slanted at a predetermined angle with respect to the horizontal, and movable in unison sideways with respect to the crankshaft. It may also be seen that such wedges may be substituted by a slot on a plate which can be pivoted to swing sideways through predetermined angles about a pivot on the crankcase at a predetermined distance above the crankshaft, while the edges of the slot, being properly curved, remain in contact with the crankshaft, or a journal providing member, containing the crankshaft. Such plate can then end along the lower edge in teeth so that it can be rotated as a worm gear, in a similar manner as the worm gear 19 is being rotated by a worm 33. One benefit in the preferred approach, using the eccentric cylinder 17, is the accuracy gained by being able to cover the desirable adjustment of compression ratio through a 180 degree rotation of the eccentric cylinder 17, thereby reducing the effect of backlash between worm gear and worm. A second advantage in the preferred approach is its compactness and that it can provide a journal bearing while resisting rotating itself as it is so prevented by the worm gear 19. However, the slot is an alternate way of adjusting the position of the crankshaft with respect to the cylinder heads, and therefore another species for implementing Embodiment A.

Embodiment B

Figure 4:
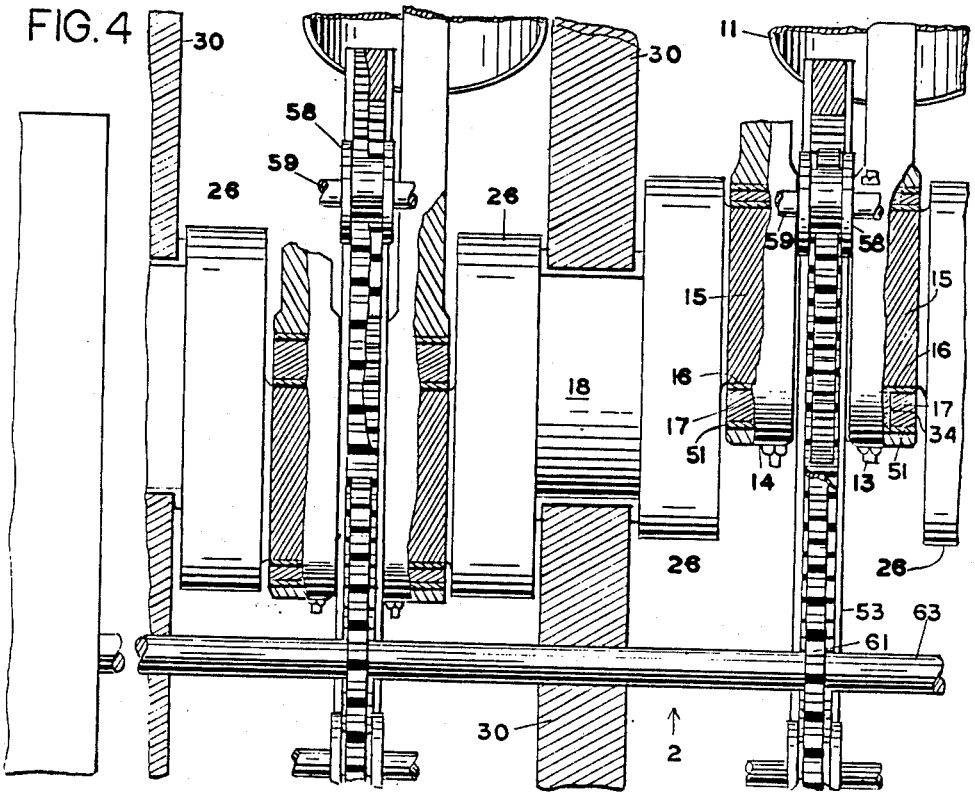
FIG. 4 is a side elevation view of embodiment B, shown in FIG. 3, in perspective, with portions of it in cross-section and portions cut away for clarity.

The details for embodiment B are shown in FIGS. 3 through 6. According to Embodiment B it is the position of the connecting rod's head bearing 39 that is being adjusted through an eccentric cylinder 17. FIGS. 3 and 4 show compression cylinders 11 and 12 being serviced by connecting rods 13 and 14, respectively. The connecting rods 13 and 14 are driven by a crankpin 15 through an eccentric cylinder 17, which is an integral part with a gear 19. A connecting rod's head bearing 51 is needed to lower friction between the connecting rod and the eccentric cylinder 17, while the crankpin bearing 39 provides low friction between the crankpin 15 and the eccentric cylinder 17. The value of the compression ratio can be adjusted by positioning the gear 19 through the internal teeth of a ring gear 53. The ring gear 53 is held concentric to the crankshaft through at least three idler rollers 58, of which the shafts 59 are rigidly attached to the crankcase 30. Assuming a counter-clockwise rotation of the crankshaft, in the direction of the arrow 5, it may easily be seen from FIG. 3 that if a particular rotational setting of the eccentric cylinder 17 is to drive both cylinders 12 and 11 with same compression ratio, the ring gear 53 must be rotating with same speed as the crankshaft 18. The angular position of the eccentric cylinder 17 corresponding to a particular compression ratio setting, is implemented by an additional rotational displacement, herein after referred to as a "rotational phase adjustment".

Figure 5:
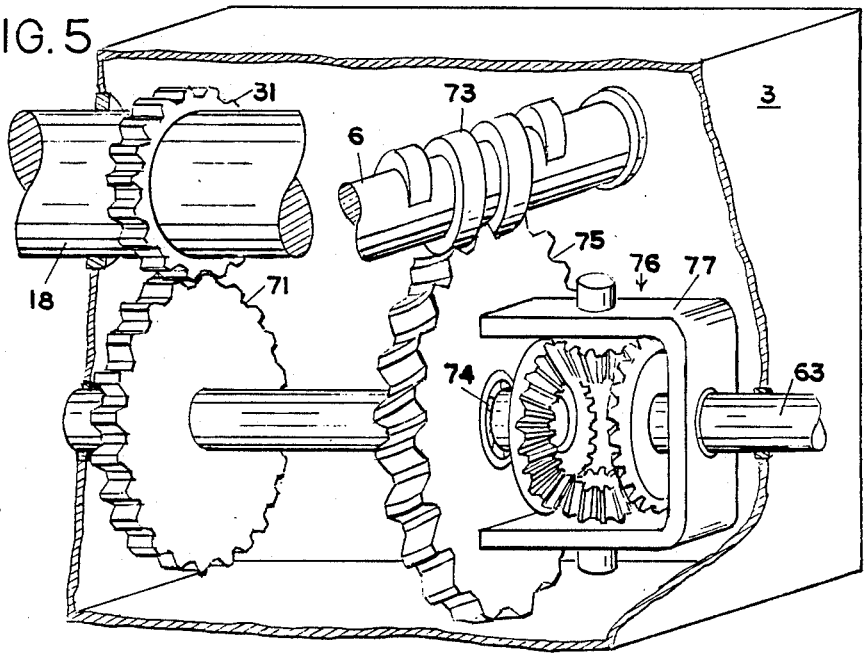
FIG. 5 is a perspective view of a first species of a rotation phase shifter, which is part of the means needed for carrying the invention, according to the Embodiment B.
Figure 6:
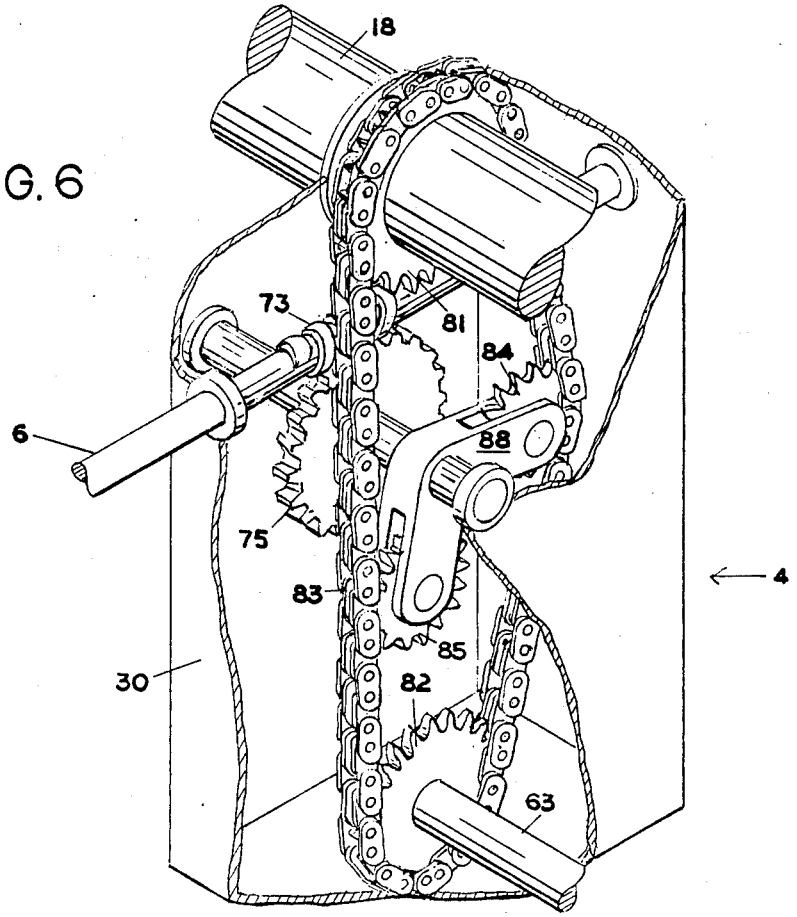
FIG. 6 is a perspective view of a second species of a rotation phase shifter, which is part of the means needed for carrying the invention, according to the Embodiment B.

FIGS. 5 and 6 show two different approaches for providing such a rotational phase adjustment. FIG. 5 shows the rate of rotation of the crankshaft to be transmitted through the meshing of gears 31, 71 and through the differential 76 to shaft 63. However, when the cage 77 is being rotated as a result of rotation of the input shaft 6 causing the worm 73 and therefore the worm gear 75 to rotate, the shaft 63 receives a positive or negative phase adjustment equal to the rotation of the worm gear 75. FIG. 3 shows the shaft 63 driving the ring gear 53 through the pinion 61, therefore transferring any phase adjustment to the rotational position of the eccentric cylinder 17.

The input shafts 6 driving the worm gears 75, can be driven by proper control and a mover such as a stepper motor, or a d.c. motor, not shown, which are well known means in the art of both digital and analog positioning controls and, therefore, will not be discussed here any further.

FIG. 6 shows a second approach for providing a rotational phase adjustment to the shaft 63. In this approach the assembly of input shaft 6, the worm 73 and worm gear 75 drive a shaft 91 which adjusts the angle of swing of a rocker 88, supporting idler sprockets 84 and 85. The rocker 88 is movably supported by the crankcase 30. The rotation of the crankshaft 18 is transmitted to the shaft 63 via two sprockets 81 and 82 and a chain or belt 83. If the rocker 88 is made to swing clockwise from the position shown in FIG. 6, the idler sprocket 85 is pushing, while the sprocket 84 is releasing the chain 83, thereby imparting a retarding motion to the chain 83, which is transmitted to the shaft 63 and is transformed into a positive rotational phase adjustment to the acentric cylinder 17 through the ring gear 53. Conversely, a counter-clockwise swing of the rocker 88 introduces a negative rotational phase adjustment in the eccentric cylinder 17.

I claim:

1. Compression ratio control for reciprocating piston engines comprising:

a reciprocating engine crankcase;

a plurality of compression/expansion cylinders rigidly attached to said crankcase;

each of said cylinders including a curved surface and a cylinder head;

a fuel mixture in-taken in said cylinders;

a piston reciprocating along each cylinder's said curved surface for providing compression/expansion to said fuel mixture;

a crank mechanism including a crankshaft rotating about an axial line that is substantially equidistant from said heads, crankcheek lobes radially extending from said crankshaft, crankpins inside and in contact with crankpin bearings, axially extending between said crankcheek lobes, and crankshaft journal bearings for providing low frictional support to said crankshaft;

a connecting rod for each of said cylinders connecting said piston with said crankpin, thereby converting the piston's reciprocating motion to crankshaft's rotary motion;

crankshaft positioning means for varying the distance of said crankshaft journal bearings and said crankshaft with respect to said cylinder heads; wherein said crankshaft positioning means is comprising crankshaft vertically displacing means and crankshaft horizontal displacement constraining means so that the axis of said crankshaft is being displace vertically, while it is simultaneously kept substantially near the vertical plane in order that said crankshaft positioning means work equally for all compression/expansion cylinders;

a first transmission gear, a crankshaft gear for meshing with said transmission gear, and a slot cut on said crankcase; wherein the constraint in the displacement of said crankshaft in the horizontal sense is provided by the vertical edges of said slot, and wherein the vertical edges of said slot are preferably being curved with a radius of curvature substantially equal to the average pitch diameter of said crankshaft gear and said first transmission gear for accurate meshing of said gears.

2. Compression ratio control for reciprocating piston engines comprising:

a reciprocating engine crankcase;

a plurality of compression/expansion cylinders rigidly attached to said crankcase;

each of said cylinders including a curved surface and a cylinder head;

a fuel mixture in-taken in said cylinders;

piston reciprocating along each cylinder's said curved surface for providing compression/expansion to said fuel mixture;

a crank mechanism including a crankshaft rotating about an axial line that is substantially equidistant from said heads; crankcheek lobes radially extending from said crankshaft; crankpins inside and in contact with crankpin bearings, axially extending between said crankcheek lobes, and crankshaft journal bearings for providing low frictional support to said crankshaft;

a connecting rod for each of said cylinders connecting said piston with said crankpin, thereby converting the piston's reciprocating motion to crankshaft's rotary motion;

crankshaft positioning means for varying the distance of said crankshaft journal bearings and said crankshaft with respect to said cylinder heads; wherein said crankshaft and said crankshaft journal bearings are eccentrically supported by eccentric cylinder means and wherein rotation of said eccentric cylinder means through a predetermined angle causes a corresponding displacement in said crankshaft's position with respect to said cylinder heads; and wherein displacement of said eccentric cylinders is prevented in the vertical sense and the displacement of said crankshaft is being constrained in the horizontal sense; thereby such displacements affecting all compression/expansion cylinders substantially equally, resulting in a substantially equal compression ratio value for all cylinders;

a first transmission gear;

a crankshaft gear for meshing with said transmission gear, and a slot cut on said crankcase; and wherein the constraint in the horizontal direction is provided by the arm means horizontally disposed and containing said crankshaft through a journal bearing, said arm means being supported by and pivoted with respect to said crankcase at a distance from the center of said crankshaft equal to the average pitch diameter of said crankshaft gear and said first transmission gears, and vertical displacement of said eccentric cylinder means is being prevented by the horizontal edges of said slot.

3. The compression ratio control for reciprocating piston engines according to claim 2, further comprising worm gear means rigidly attached to said eccentric cylinder means, worms for driving said worm gear means, shafts for holding and driving said worms, and same handed helical pairs of gear means for transferring rotation from a common input shaft means at 90 degree angle to said worm holding shafts.

4. Compression ratio control for reciprocating piston engines comprising:

a reciprocating engine crankcase;

a plurality of compression/expansion cylinders rigidly attached to said crankcase, each of said cylinders including a curved surface and a cylinder head;

a fuel mixture in-taken in said cylinders, a piston reciprocating along each cylinder's said curved surface for providing compression/expansion to said fuel mixture;

a crank mechanism including a crankshaft rotating about an axial line that is substantially equidistant from said heads; crankcheek lobes radially extending from said crankshaft; crankpins inside and in contact with crankpin bearings, axially extending between said crankcheek lobes, and crankshaft journal bearings for providing low frictional support to said crankshaft;

a connecting rod for each of said cylinders connecting said piston with said crankpin, thereby converting the piston's reciprocating motion to crankshaft's rotary motion;

connecting rod's head bearing positioning means with respect to said cylinder heads; wherein said connecting rod's head bearings are being supported by eccentric cylinder means and wherein rotation of said eccentric cylinder means through a predetermined angle causes a corresponding displacement in said connecting rod's head position with respect to said cylinder heads;

gear means rigidly attached to said eccentric cylinder means, ring gear means concentric to said crankshaft rotatably supported on said crankcase, inner gear teeth on the inner side of said ring gear means for driving said eccentric gear means, external gear teeth on the outer side of said gear means, a driving pinion coupled with said external teeth of said ring gear means and rotation phase adjusting means driving said pinion for accurately adjusting the rotational setting of said eccentric cylinder with respect to said connecting rods, and thereby, the value of the engine compression ratio.

5. The compression ratio control for reciprocating piston engines according to claim 4, wherein said rotation phase adjusting means is implemented by use of a differential mechanism means.

6. The compression ratio control for reciprocating piston engines according to claim 5, further comprising gear transmission means for coupling the rotation of said crankshaft to said differential mechanism means, and means for adjusting the rotation of the cage of said differential mechanism means proportionately to the rotation of a compression ratio setting input shaft means.

7. The compression ratio control for reciprocating piston engines according to claim 6, wherein said cage rotation adjusting means comprises a worm with a worm gear combination means.

8. The compression ratio control for reciprocating piston engines according to claim 4, wherein said rotation phase adjusting means is implemented by the use of a rocker/chain-like means.

9. The compression ratio control for reciprocating piston engines according to claim 8, including idler sprockets rotatably supported by said rocker means, a crankshaft sprocket, a shaft driving sprocket, chain-like means for transferring rotational motion from said crankshaft sprocket to said shaft driving sprocket, and rotation input means for adjusting the angle of tilt of said rocker means; whereby as said rocker means is being tilted through a predetermined angle, said idler sprockets alter the chain-like means' path, thereby advancing or retarding the rotational angle of said shaft sprocket means and therefore adjusting the engine compression ratio to a predetermined value.

* * * * *